US011123242B2

(12) United States Patent
Puschmann et al.

(10) Patent No.: US 11,123,242 B2
(45) Date of Patent: Sep. 21, 2021

(54) MOTORIZED WHEELCHAIR CHASSIS AND MOTORIZED WHEELCHAIR COMPRISING THE SAME

(71) Applicant: Invacare International GmbH, Witterswil (CH)

(72) Inventors: Axel Puschmann, Rehburg-Loccum (DE); Peter Jost, Kalletal (DE); Julian Kyle Verkaaik, Avon, OH (US)

(73) Assignee: INVACARE INTERNATIONAL GMBH, Witterswil (CH)

( * ) Notice: Subject to any disclaimer, the term of this patent is extended or adjusted under 35 U.S.C. 154(b) by 142 days.

(21) Appl. No.: 16/675,365

(22) Filed: Nov. 6, 2019

(65) Prior Publication Data

US 2020/0163815 A1 May 28, 2020

(30) Foreign Application Priority Data

Nov. 22, 2018 (EP) ..... 18207892

(51) Int. Cl.
*A61G 5/04* (2013.01)
*A61G 5/10* (2006.01)

(52) U.S. Cl.
CPC ..... *A61G 5/04* (2013.01); *A61G 5/1078* (2016.11)

(58) Field of Classification Search
CPC ..... A61G 5/045; A61G 5/078; A61G 5/1081
See application file for complete search history.

(56) References Cited

U.S. PATENT DOCUMENTS 3,794,132 A * 2/1974 Moon ..... A61G 5/042 180/13
3,882,949 A * 5/1975 Anderson ..... A61G 5/06 180/8.2
5,020,816 A * 6/1991 Mulholland ..... A61G 5/08 280/250.1

(Continued)

FOREIGN PATENT DOCUMENTS

EP 2497452 9/2012

OTHER PUBLICATIONS

Ball Joint, Wikipedia, 6 pages, printed Sep. 4, 2019.

(Continued)

*Primary Examiner* — Jeffrey J Restifo
(74) *Attorney, Agent, or Firm* — Calfee, Halter & Griswold LLP

(57) ABSTRACT

A motorized wheelchair chassis includes a frame assembly having a first frame element that supports first and second caster wheels at an end of the first frame element. The first frame element is designed to support a seat assembly, a battery support assembly secured to an underside of the frame assembly, at least one battery, first and second power drive assemblies disposed on lateral sides of the battery support assembly, and first and second drive wheels driven by the first and second power drive assemblies, respectively. The frame assembly further comprises a second frame element that is secured to the battery support assembly. The first frame element is supported onto the second frame element via a coupling structure comprising a ball-joint bearing permitting relative movement of the first frame element with respect to the second frame element in more than two degrees of freedom within a limited range of movement.

19 Claims, 7 Drawing Sheets

(CROSS-SECTION A-A)

(56) References Cited

U.S. PATENT DOCUMENTS 5,261,684 A * 11/1993 Soto ..... A61G 5/00 280/250.1
5,772,237 A * 6/1998 Finch ..... A61G 5/06 180/65.1
6,068,280 A * 5/2000 Torres ..... A61G 5/045 180/328
7,040,429 B2 * 5/2006 Molnar ..... A61G 5/043 180/65.1
7,066,290 B2 * 6/2006 Fought ..... A61G 5/043 180/65.51
7,219,924 B2 * 5/2007 Mulhern ..... G06F 9/383 180/65.51
7,232,008 B2 * 6/2007 Levi ..... A61G 5/043 180/907
7,264,272 B2 * 9/2007 Mulhern ..... A61G 5/043 180/65.1
7,316,282 B2 * 1/2008 Mulhern ..... A61G 5/043 180/65.1
7,389,835 B2 * 6/2008 Mulhern ..... A61G 5/042 180/22
7,506,709 B2 * 3/2009 Kiwak ..... A61G 5/043 180/65.1
7,556,109 B2 * 7/2009 Chen ..... A61G 5/043 180/65.1
7,896,394 B2 * 3/2011 Jackson ..... B60G 21/045 280/755
7,909,354 B2 * 3/2011 Easton ..... A61G 5/1059 280/643
8,739,917 B2 * 6/2014 Pierce ..... B60G 5/04 180/299
9,073,399 B1 * 7/2015 Richter ..... A61G 5/06
9,682,603 B2 * 6/2017 Richter ..... A61G 5/1075
9,808,383 B2 * 11/2017 Mulhern ..... A61G 5/125
10,183,543 B2 * 1/2019 Rambaud ..... B60K 1/04
2012/0217732 A1 * 8/2012 Knuutinen ..... B60G 21/04 280/781

OTHER PUBLICATIONS

Search Report from European Patent Application No. 18207892.3 dated Jul. 22, 2019.
Invacare Kite brochure, 4 pgs. (2017).

* cited by examiner (CROSS-SECTION A-A)

MOTORIZED WHEELCHAIR CHASSIS AND MOTORIZED WHEELCHAIR COMPRISING THE SAME

RELATED APPLICATIONS

This application claims priority to European Patent Application No. 18207892.3, filed on Nov. 22, 2018, the entire disclosure of which is incorporated by reference in its entirety.

TECHNICAL FIELD

The present invention generally relates to a motorized wheelchair chassis and to a motorized wheelchair comprising the same.

BACKGROUND OF THE INVENTION

European Patent Publication No. EP 2 497 452 A1, which is incorporated herein by reference, discloses a motorized wheelchair chassis for a motorized wheelchair, which motorized wheelchair chassis comprises a frame assembly including a frame element that supports first and second caster wheels at a front end of the frame element, which frame element is designed to support a seat assembly. The motorized wheelchair chassis further comprises a battery support assembly secured to an underside of the frame assembly and supporting at least one battery, first and second power drive assemblies disposed on lateral sides of the battery support assembly, and first and second drive wheels driven by the first and second power drive assemblies. This motorized wheelchair chassis, which is put into practice in Invacare®'s Kite® wheelchair, includes a suspension system based on a so-called "Dual Swing Technology (D.S.T.)®", which suspension system allows the frame element to pivot relative to the battery support assembly about two orthogonal axes, namely a longitudinal axis extending parallel to the rear to front direction and a transverse axis extending transversally to the longitudinal axis. This dual-axis pivoting movement is made possible thanks to the use of a special bracket connecting the frame element to the battery support assembly, which bracket is adapted to pivot with respect to the battery support assembly about the longitudinal axis and comprises a pair of pivotal bearing elements defining the transverse axis, to which the frame element is pivotally connected. A pair of shock absorbers are further interposed between the frame element and the battery support assembly to restrict the relative movement between the frame element and the battery support assembly.

This dual-swing suspension provides good traction, driving comfort and leads to improved compactness, but further improvements are desired. One limitation of the aforementioned dual-swing suspension in particular resides in the fact that relative pivoting movement of the frame element with respect to the battery support assembly is only possible about two orthogonal axes as explained above. This inherently leads to certain limitations in terms of traction and driving comfort, which may still be improved. Further improvements in terms of compactness are also desirable.

SUMMARY OF THE INVENTION

A general aim of the invention is to provide such an improved motorized wheelchair chassis.

More specifically, an aim of the present invention is to provide such a motorized wheelchair chassis that provides even better traction.

Yet another aim of the invention is to provide a motorized wheelchair chassis that provides improved driving comfort.

A further aim of the invention is to provide a motorized wheelchair chassis that can be made even more compact.

Still another aim of the invention is to provide a motorized wheelchair chassis that provides further improvements in terms of serviceability, e.g. facilitates access to the batteries.

These aims are achieved thanks to the solutions defined in the claims.

In accordance with the invention, there is provided a motorized wheelchair chassis according to claim 1, namely a motorized wheelchair chassis comprising a frame assembly including a first frame element that supports first and second caster wheels at an end of the first frame element, which first frame element is designed to support a seat assembly, a battery support assembly secured to an underside of the frame assembly and supporting at least one battery, first and second power drive assemblies disposed on lateral sides of the battery support assembly, and first and second drive wheels driven by the first and second power drive assemblies, respectively. According to the invention, the frame assembly further comprises a second frame element, which is secured to the battery support assembly, and the first frame element is supported onto the second frame element via a coupling structure comprising a ball-joint bearing permitting relative movement of the first frame element with respect to the second frame element in more than two degrees of freedom within a limited range of movement.

According to a preferred embodiment of the invention, the ball-joint bearing is interposed between the first and second frame elements and supports a portion of the first frame element onto a corresponding portion of the second frame element, the ball-joint bearing being provided along a longitudinal axis extending centrally between the drive wheels and between the caster wheels, the ball-joint bearing exhibiting a main bearing axis that is comprised within a vertical plane passing by the longitudinal axis. The main bearing axis of the ball-joint bearing may in particular be substantially vertical.

In the context of this preferred embodiment, the ball-joint bearing may in particular comprises a bearing socket provided on one of the first and second frame elements (such as the second frame element) and a bearing stud designed to be received inside the bearing socket, which bearing stud is provided on the other one of the first and second frame elements (such as the first frame element).

By way of preference, the coupling structure may further comprise a retaining mechanism designed to retain the first frame element onto the second frame element as well as the ball-joint bearing in engagement between the first and second frame elements, while still permitting the relative movement of the first frame element with respect to the second frame element about the ball-joint bearing.

Advantageously, the aforementioned retaining mechanism may include at least a screw or bolt element cooperating with a retaining element to retain the first frame element onto the second frame element. In that context, the retaining mechanism may further include at least a first elastic member, which first elastic member is disposed along a portion of the screw or bolt element and is interposed between the first and second frame elements. The retaining mechanism may further include at least a second elastic member, which second elastic member is disposed along another portion of the screw or bolt element and is interposed between the retaining element and the first or second frame element (e.g. the second frame element).

Advantageously, a wheelbase of the motorized wheelchair chassis may be adjustable. This can in particular be achieved thanks to the second frame element being securable to the battery support assembly at a plurality of longitudinal positions along a longitudinal axis.

According to yet another preferred embodiment of the invention, the motorized wheelchair chassis further comprises an elastic structure interposed between the first and second frame elements. This elastic structure may advantageously comprise first and second elastic elements, such as rubber springs, interposed between the first and second frame elements, which first and second elastic elements are preferably located on either side of the battery support assembly, between the drive wheels and the battery support assembly.

According to a further advantageous embodiment of the invention, the battery support assembly supports first and second battery units. In this context, the first battery unit may in particular be arranged in front of the second battery unit in a longitudinal configuration along a longitudinal axis, and clearances may be provided in the lateral sides of the battery support assembly, next to the location of the first battery unit, to accommodate part of the first and second power drive assemblies.

According to a further embodiment of the invention, the motorized wheelchair chassis further comprises a power electronic module, which power electronic module is mounted on a front face of the battery support assembly.

By way of preference, the at least one battery is accessible from a rear end of the battery support assembly, which facilitates maintenance operations and improves serviceability.

Also claimed is a motorized wheelchair comprising a motorized wheelchair chassis according to the invention.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1:
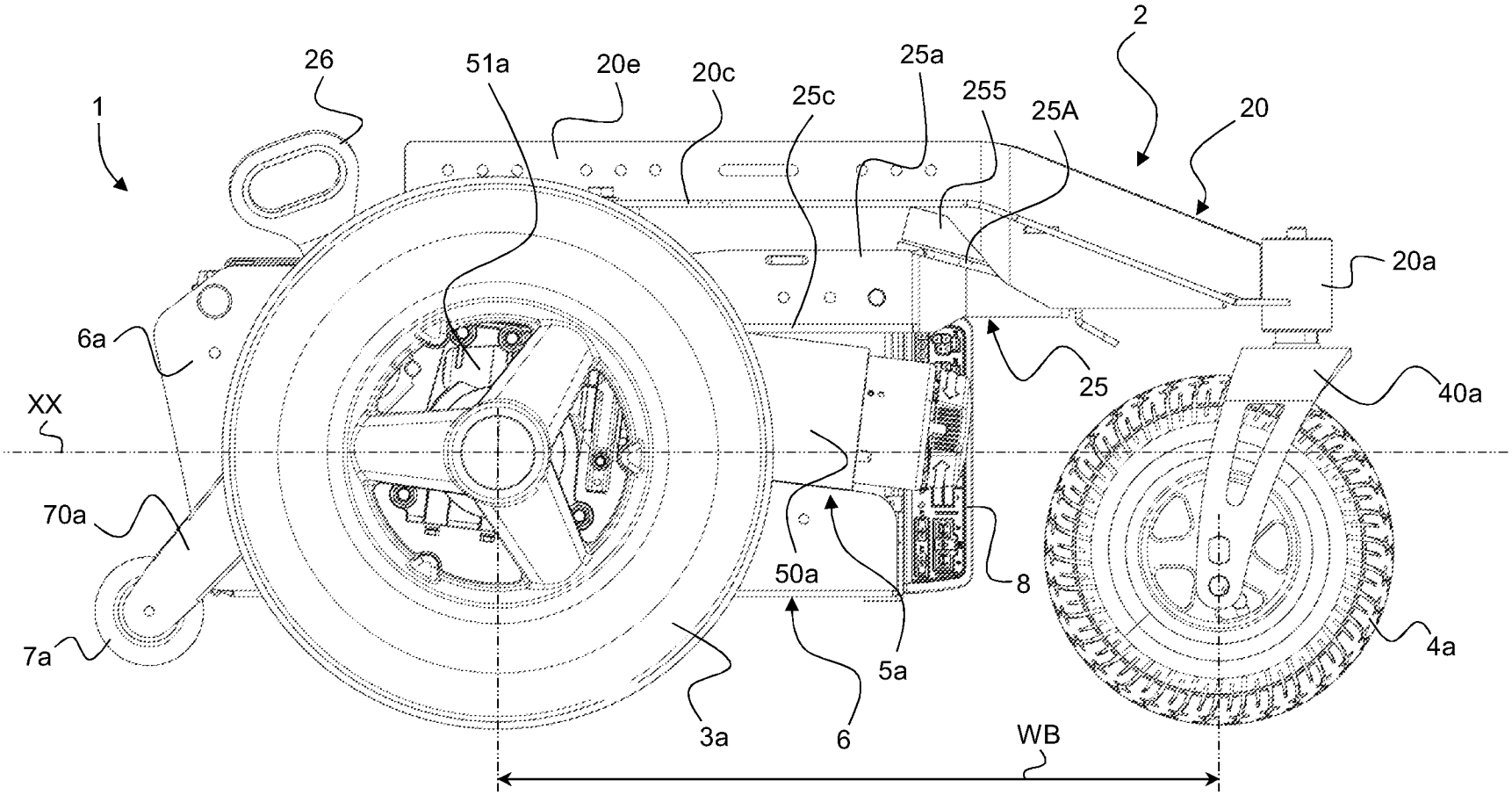
FIG. 1 is a side view of chassis of a motorized wheelchair in accordance with a preferred embodiment of the invention.

The present invention will be described in relation to various illustrative embodiments. It shall be understood that the scope of the invention encompasses all combinations and sub-combinations of the features of the embodiments disclosed herein.

As described herein, when two or more parts or components are described as being connected, secured or coupled to one another, they can be so connected, secured or coupled directly to each other or through one or more intermediary parts.

The invention will be described in relation to various embodiments of a motorized wheelchair as depicted in FIGS. 1 to 7. FIGS. 1 to 7 actually show a motorized wheelchair chassis, designated globally by reference numeral 1, of the motorized wheelchair. It is to be understood that the motorized wheelchair chassis 1 would typically support a seat assembly, including a seat, and additional seat components such as armrests, legrest and/or footrests as well as further components, such as wheelchair controls and the like. The seat assembly and related components are not shown in FIGS. 1 to 7 as they do not directly impact the invention.

As illustrated in FIGS. 1 to 7, the motorized wheelchair chassis 1 comprises a frame assembly 2 including a first frame element 20 that supports first and second caster wheels 4*a*, 4*b* at an end of the first frame element 20. In the illustrated example, the first and second caster wheels 4*a*, 4*b* are supported at a front end of the wheelchair chassis 1, namely by means of first and second supports 20*a*, 20*b*. The caster wheels 4*a*, 4*b* are pivotally connected to the supports 20*a*, 20*b* by means of corresponding fork elements 40*a*, 40*b*, as is typical in the art. The first frame element 20 is also designed to support the aforementioned seat assembly. To this end, the first frame element 20 exhibits a pair of vertical ribs 20*e*, 20*f* providing support for attaching and securing the relevant seat assembly.

The wheelchair chassis 1 further comprises a battery support assembly 6, which is secured to an underside of the frame assembly 2 and supports at least on battery. In the illustrated example, the battery support assembly 6 is actually designed and dimensioned to carry two battery units 61, 62. These battery units 61, 62 can be held in place, in the battery support assembly 6, by means of a fastening strap 6*d* and a pair of brackets 6*e*, 6*f*. In the illustrated example, one may appreciate that the batteries 61, 62 are easily accessible from a rear end of the battery support assembly 6, after removal of the fastening strap 6*d* and brackets 6*e*, 6*f*.

The battery support assembly 6 is secured to the frame assembly 2 via a second frame element 25, which is disposed below the first frame element 20. In the illustrated example, the second frame element 25 comprises a pair of vertical ribs 25*a*, 25*b* that are securable to a corresponding portion of lateral sides 6*a*, 6*b* of the battery support assembly 6, by means e.g. of screws or bolts, other solutions being possible.

Located on either side of the battery support assembly 6, namely on each lateral side 6*a*, 6*b*, are first and second power drive assemblies 5*a*, 5*b*. Each power drive assembly 5*a*, 5*b* preferably comprises an electric motor 50*a*, resp. 50*b*, that is coupled to an associated gearbox 51*a*, resp. 51*b*. The power drive assemblies 5*a*, 5*b* are known as such in the art, for instance from European Patent Publication No. EP 2 497 452 A1 mentioned in the preamble hereof, and are specifically designed and intended to drive first and second drive wheels 3*a*, 3*b* located at a rear portion of the wheelchair chassis 1, on either side of the battery support assembly 6.

In a manner similar to the wheelchair chassis disclosed in European Patent Publication No. EP 2 497 452 A1, the power drive assemblies 5*a*, 5*b* are mounted directly onto the lateral sides 6*a*, 6*b* of the battery support assembly 6 and the drive wheels 3*a*, 3*b* are coupled to a corresponding output shaft of the power drive assemblies 5*a*, 5*b*. This once again leads to a very compact arrangement. Provisions can be contemplated to enable quick manual engagement or disengagement of the motors 50*a* and/or 50*b* by rotation of a knob (or lever) provided on a head portion of the motors 50*a*, 50*b*.

Also shown in the drawings (see especially FIGS. 1, 2, 5 and 6) is a power electronic module 8, connected to the battery units 61, 62, and used to operate the power drive assemblies 5*a*, 5*b*. The power electronic module 8 is advantageously mounted on a front face 6*c* of the battery support assembly 6, as shown, which is made possible thanks to the configuration of the wheelchair chassis 1 of the present invention. By moving the power electronic module 8 to the front face 6*c* of the battery support assembly 6, rear access to the batteries 61, 62 is improved and greatly facilitated.

FIGS. 1 to 7 also show the provision of a pair of anti-tip wheels 7*a*, 7*b*, located at the rear end of the wheelchair chassis 1, which anti-tip wheels 7*a*, 7*b* are also mounted on the lateral sides 6*a*, 6*b* of the battery support assembly 6 by means associated supports 70*a*, 70*b*.

Figure 2:
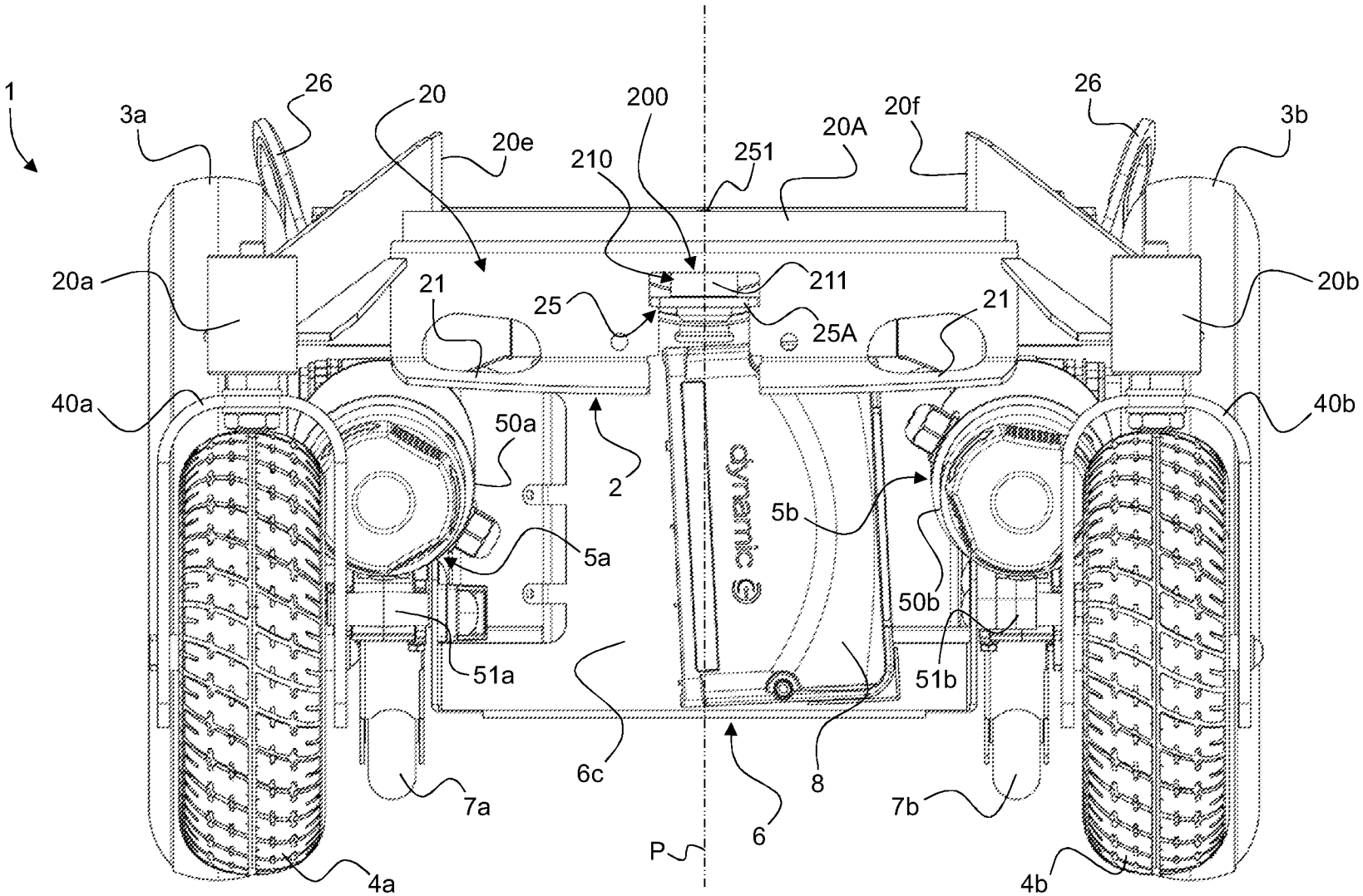
FIG. 2 is a front view of the chassis of FIG. 1.
Figure 3:
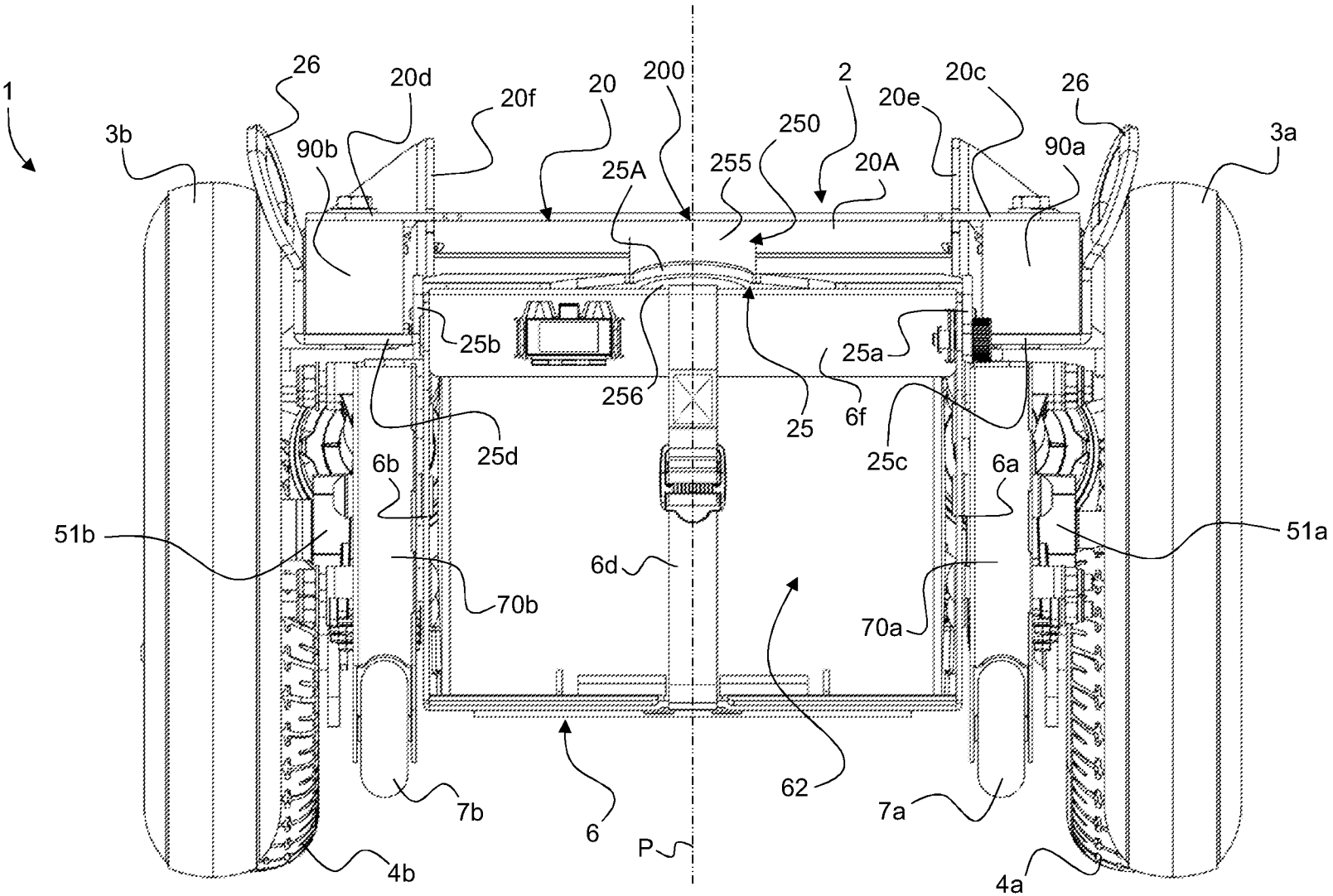
FIG. 3 is a rear view of the chassis of FIG. 1.
Figure 4:
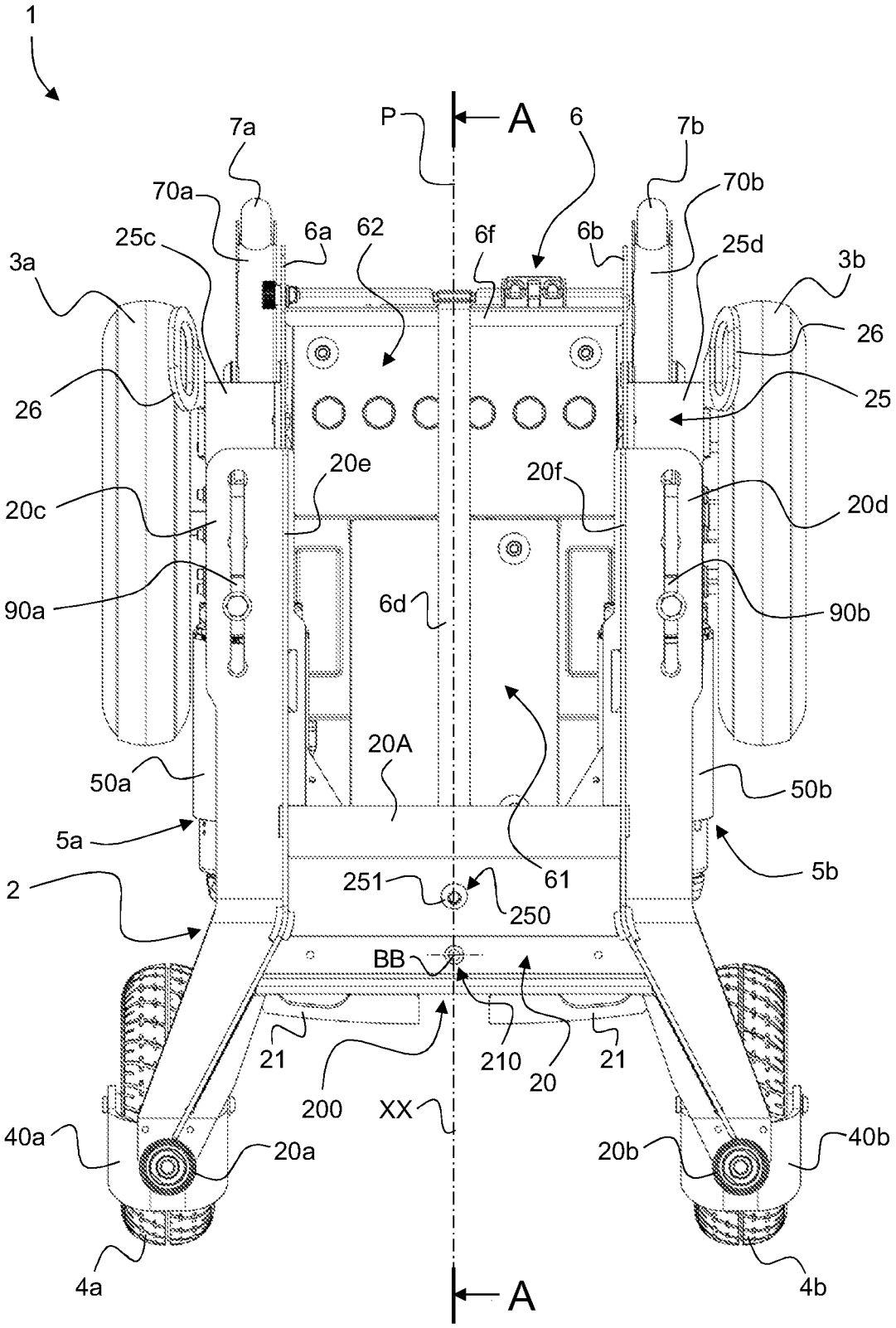
FIG. 4 is a top view of the chassis of FIG. 1.
Figure 5:
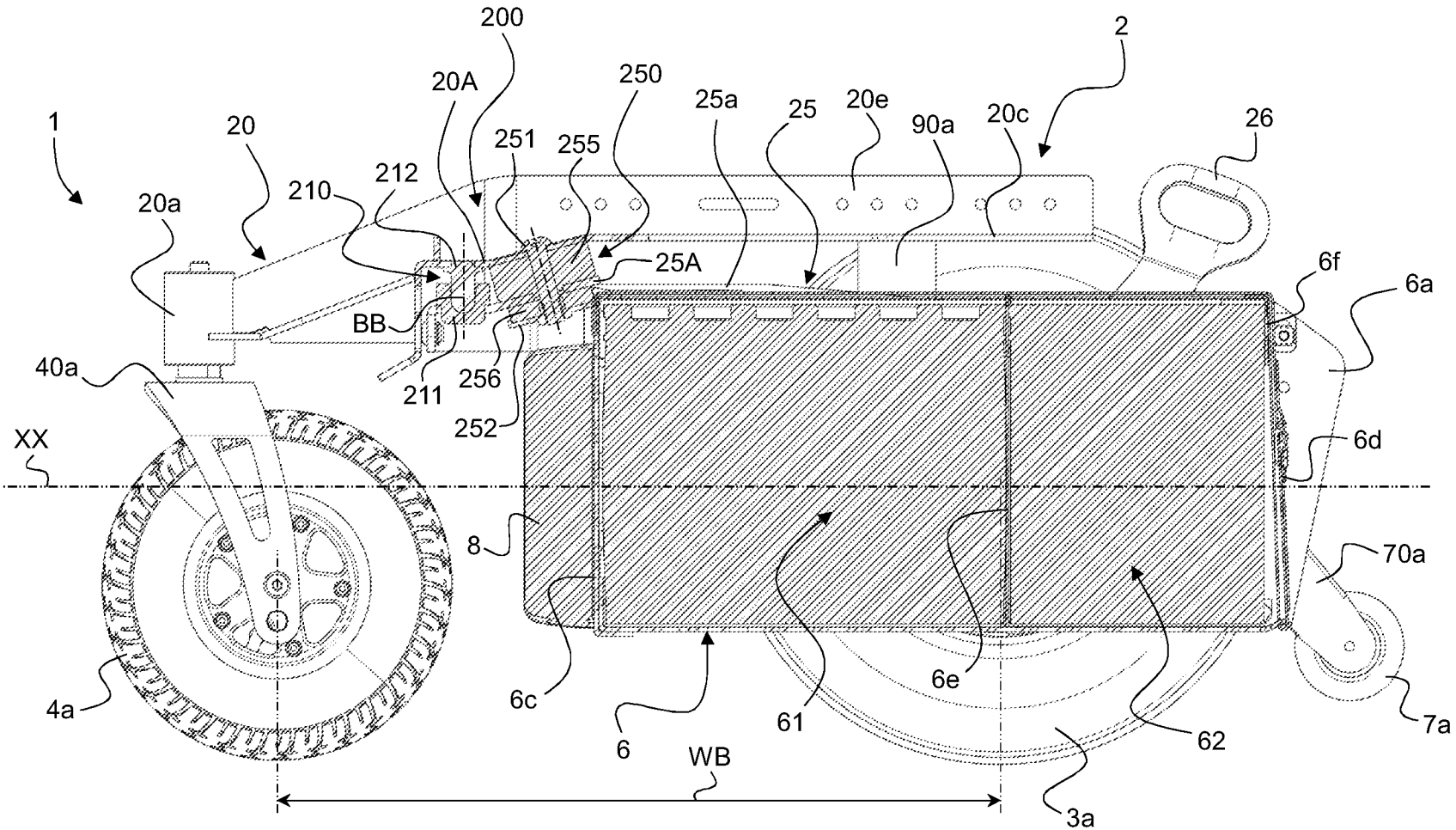
FIG. 5 is a cross-sectional view of the chassis of FIG. 1 as taken along sectional plane A-A reproduced in FIG. 4.
Figure 6:
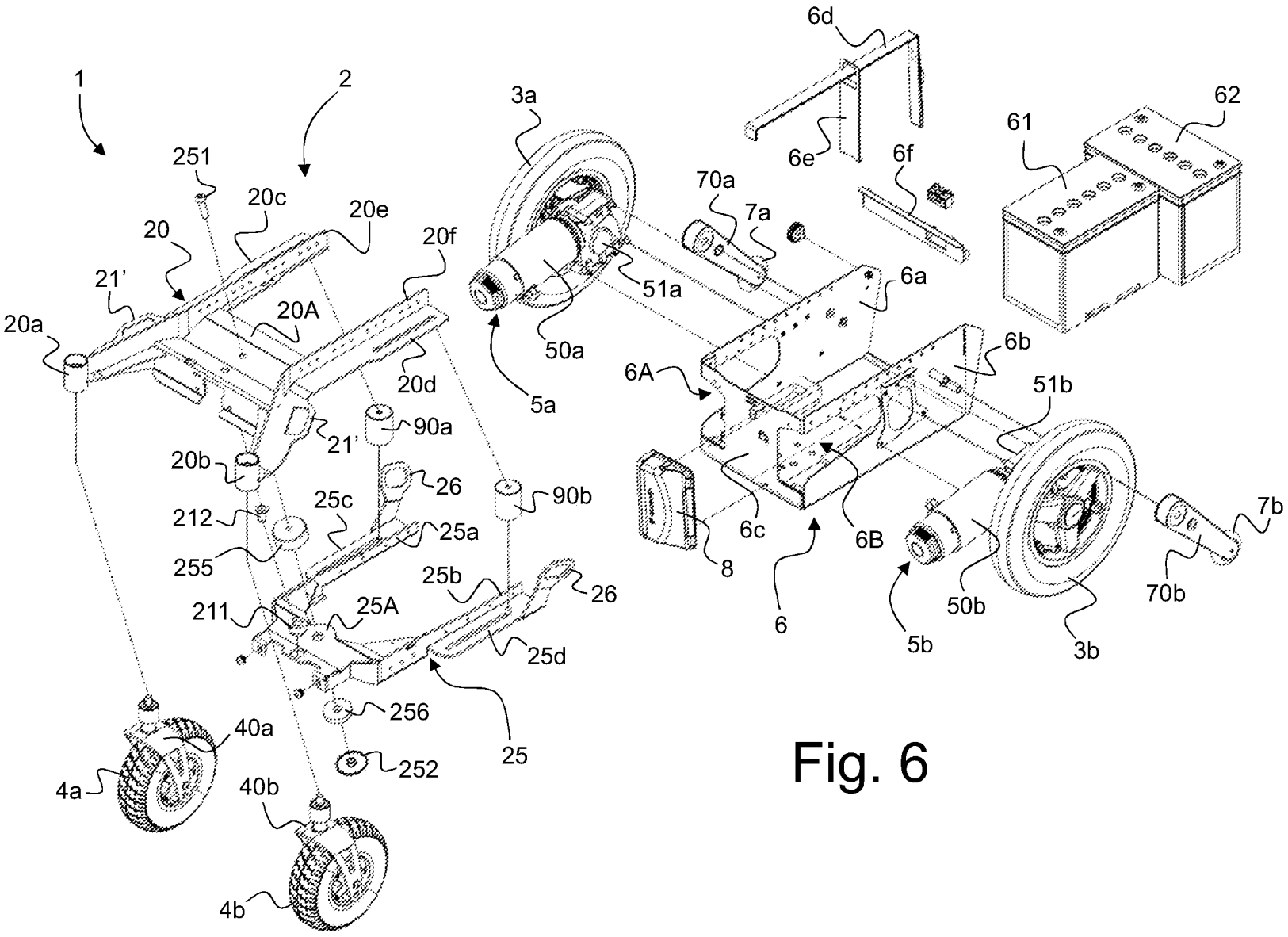
FIG. 6 is an exploded view of the chassis of FIG. 1.
Figure 7:
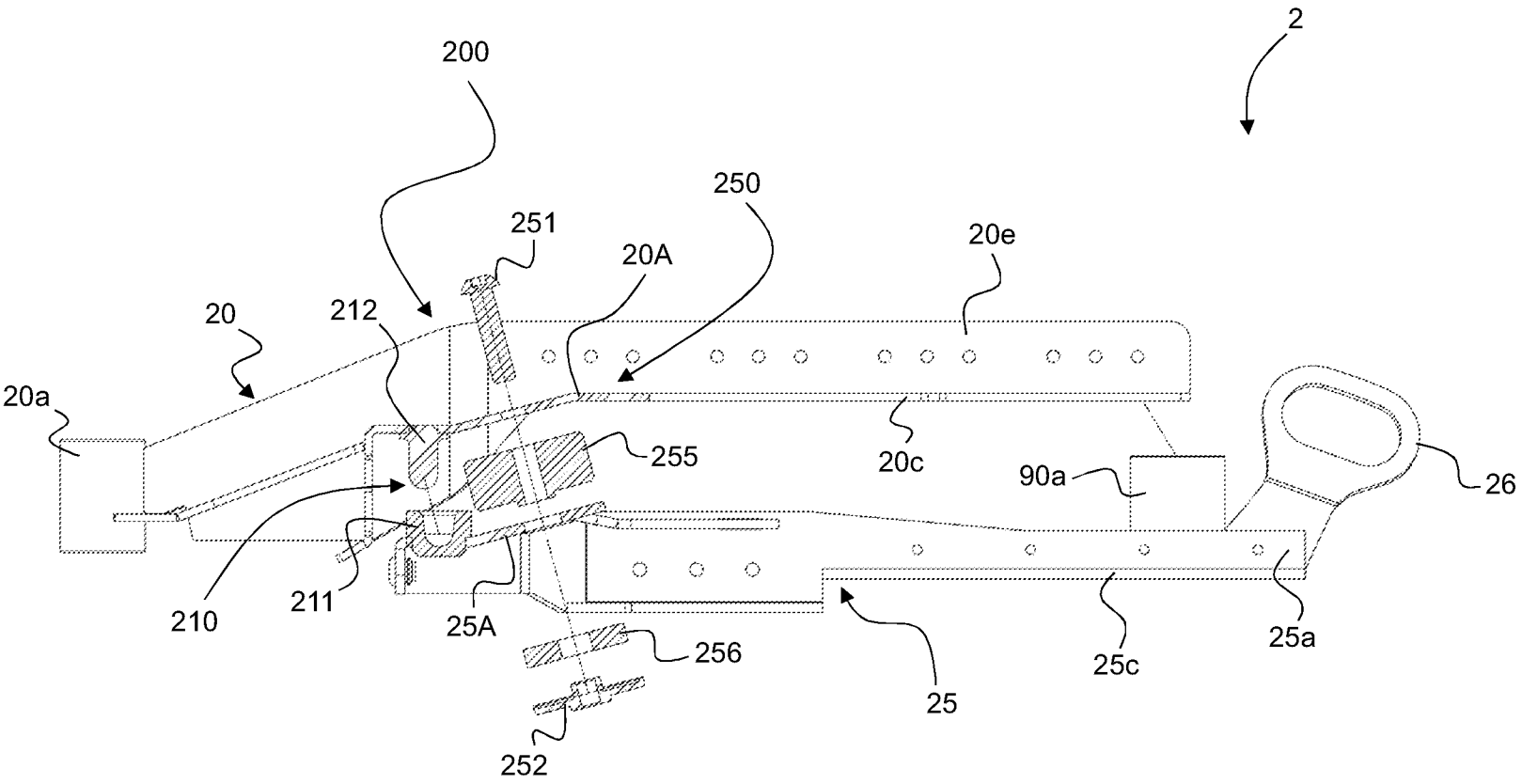
FIG. 7 is partial cross-sectional view of a frame assembly of the chassis of FIG. 1 showing the frame assembly in a partially disassembled configuration.

Reference numerals 21 and 26 each designate a pair of tie-down (or anchor) points provided on the frame assembly 2, namely on the first frame element 20 and on the second frame element 25. Snap hooks or belt loops can be used in connection with the four anchor points 21, 26 for securing the wheelchair onto a surface, for instance with a view to secure the wheelchair in a vehicle. These anchor points can be provided at any adequate position on the frame assembly 2 (see e.g. FIG. 6 which shows anchor points 21' positioned on either side of the first frame element 20, rather than on a front side of the cross-member 20A as shown in FIGS. 2 and 4).

Turning back to the frame assembly 2 of the invention, the first frame element 20 is supported onto the second frame element 25 via a dedicated coupling structure 200 (see especially FIGS. 5 and 7) that comprises a ball-joint bearing 210. This ball-joint bearing 210 permits relative movement of the first frame element 20 with respect to the second frame element 25 in more than two degrees of freedom within a limited range of movement.

In the illustrated embodiment, the ball-joint bearing 210 is specifically interposed between the first and second frame elements 20, 25 and supports a portion, designated by reference numeral 20A, of the first frame element 20 onto a corresponding portion, designated by reference numeral 25A, of the second frame element 25. In the illustrated embodiment, portions 20A, 25A are corresponding cross-members of the first and second frame elements 20, 25, as is more clearly visible in the exploded view of FIG. 6.

More specifically, the ball-joint bearing 210 is advantageously provided along a longitudinal axis XX extending centrally between the drive wheels 3*a*, 3*b* and between the caster wheels 4*a*, 4*b* (see in particular FIG. 4), the ball-joint bearing 210 exhibiting a main bearing axis BB that is comprised within a vertical plane P passing by the longitudinal axis XX. This main bearing axis BB is preferably substantially vertical.

The ball-joint bearing 210 preferably includes a bearing socket 211 provided on one of the first and second frame element 20, 25 and a bearing stud 212 designed to be received inside the bearing socket 211, which bearing stud 212 is provided on the other one of the first and second frame elements 20, 25. In the illustrated example, the bearing socket 211 is provided on the second frame element 25 (namely on an upper side of cross-member 25A) and the bearing stud 212 is provided on the first frame element 20 (namely on a bottom side of cross-member 20A).

It will be appreciated that the ball-joint bearing 210 permits relative movement of the first frame element 20 with respect to the second frame element 25 in more than two degrees of freedom about the ball-joint bearing 210 within a limited range of movement. This is however sufficient to greatly improve the wheelchair's ability to cope with and be driven onto uneven surfaces.

Preferably, the coupling structure 200 further comprises a retaining mechanism designed to retain the frame element 20 onto the second frame element 25, as well as the ball-joint bearing 210 in engagement. The ball-joint bearing 210 per se could be designed in such a way as to avoid disengagement of the components of ball-joint bearing 210, for instance by retaining the bearing portion of the bearing stud 212 directly inside the bearing socket 211. This may however further restrict freedom of movement about the ball-joint bearing 210. Therefore, in accordance with a particularly preferred embodiment of the invention, the coupling structure 200 comprises a dedicated retaining mechanism 250, separate from the ball-joint bearing 210, which retaining mechanism 250 is designed to retain the first frame element 20 onto the second frame element 25, as well as the ball-joint bearing 210 in engagement between the first and second frame elements 20, 25, while permitting the relative movement of the first frame element 20 with respect to the second frame element 25 about the ball-joint bearing 210.

The retaining mechanism 250 may in particular comprise at least a screw or bolt element 251 cooperating with a retaining element 252 to retain the first frame element 20 onto the second frame element 25. As shown e.g. in FIGS. 5 and 7, the screw or bolt element 251 is provided on the cross-member 20A of the first frame element 20 (and here extends obliquely within vertical plane P) and extends into a corresponding aperture provided in the cross-member 25A of the second frame element 25, the retaining element 252 being secured to the free end of the screw or bolt element 251, under a bottom side of the cross-member 25A. The aperture provided in cross-member 25A is sufficiently big to permit relative movement between the first and second frame elements 20, 25 about the ball-joint bearing 210, within a limited range of movement.

By way of preference, the retaining mechanism 250 further includes at least a first elastic member 255, which first elastic member 255 is disposed along a portion of the screw or bolt element 251 and is interposed between the first and second frame elements 20, 25. This first elastic member 255 provides some elastic support between frame elements 20, 25. A second elastic member 256 may likewise be provided, as shown, which second elastic member 256 is disposed along another portion of the screw or bolt element 251 and is interposed between the retaining element 252 and, here, the second frame element 25. The first and second elastic members 255, 256 are especially useful in accommodating the relative movement between the first and second frame elements 20, 25 and avoiding stress and damages on the retaining mechanism 250 and/or the frame elements 20, 25.

By way of preference, the wheelchair chassis 1 further comprises an elastic structure interposed between the first and second frame elements 20, 25. This elastic structure may in particular comprise, as shown, first and second elastic elements 90*a*, 90*b*, such as rubber springs, that are interposed between the first and second frame elements 20, 25. In the illustrated example, the first and second elastic elements 90*a*, 90*b* are advantageously located on either side of the battery support assembly 6, between the drive wheels 3*a*, 3*b* and the battery support assembly 6. The first and second elastic elements 90*a*, 90*b* can conveniently be interposed between corresponding pairs of horizontal ribs 20*c*, 25*c*, respectively 20*d*, 25*d*, provided on either side of the first and second frame elements 20, 25, and a longitudinal position thereof, along the horizontal ribs 20*c*, 25*c*, resp. 20*d*, 25*d*, is advantageously adjustable. The addition of the aforementioned elastic structure 90*a*, 90*b* ensures optimal comfort of suspension, traction and driveability.

In accordance with an advantageous embodiment of the invention, a wheelbase WB of the motorized wheelchair chassis 1 may be adjustable. This can in particular be achieved by designing the second frame element 25 in such a way that it is securable to the battery support assembly 6 at a plurality of longitudinal positions along the longitudinal axis XX. This is made possible thanks to the configuration of the frame assembly 2 of the invention.

As already mentioned hereabove, the battery support assembly 6 may support first and second battery units 61, 62. Advantageously, the first battery unit 61 may be arranged in front of the second battery unit 62 in a longitudinal configuration along the longitudinal axis XX (see FIGS. 4-6), which creates additional space on both longitudinal sides of the first battery unit 61. This additional space can be put to good use to improve compactness even further by creating clearances 6A, 6B in the lateral sides 6*a*, 6*b* of the battery support assembly 6, next to the location of the first battery unit 61, to accommodate part of the first and second power drive assemblies 5*a*, 5*b*, namely part of the electric motors 50*a*, 50*b* in the present instance, partially inside the battery support assembly 6 as this can be seen more clearly in FIGS. 2 and 4.

Various modifications and/or improvements may be made to the above-described embodiments without departing from the scope of the invention as defined by the annexed claims. For instance, the driving wheels do not necessarily need to be positioned behind the caster wheels, as shown, but could alternatively be positioned in front of the caster wheels. In that respect, in the illustrated embodiment, the ball-joint bearing is advantageously located in front of the battery support assembly, close to the front axle formed by the front caster wheels, but the relevant location of the ball-joint bearing could be moved to any other adequate location along the longitudinal axis.

In addition, it will be understood that the relevant locations of the bearing socket and bearing stud could be reversed. Furthermore, while the illustrated embodiment makes use of a combination of a bearing socket and bearing stud, other types of ball-joint bearings could be contemplated, including for instance so-called spherical rolling joints (or "SRJ") which additionally make use of a ball bearing arrangement interposed between the inner spherical surface of the socket and the outer spherical surface of the stud. More generally, substantially the same function could be replicated by means a ball-joint bearing comprising inner and outer spherical rings.

The invention claimed is:

1. A motorized wheelchair chassis comprising:

a frame assembly including a first frame element that supports first and second caster wheels at an end of the first frame element, which first frame element is designed to support a seat assembly;

a battery support assembly secured to an underside of the frame assembly and supporting at least one battery;

first and second power drive assemblies disposed on lateral sides of the battery support assembly; and first and second drive wheels driven by the first and second power drive assemblies, respectively;

wherein the frame assembly further comprises a second frame element, which is secured to the battery support assembly; and wherein the first frame element is supported onto the second frame element via a coupling structure comprising a ball-joint bearing permitting relative movement of the first frame element with respect to the second frame element in more than two degrees of freedom within a limited range of movement.

2. The motorized wheelchair chassis according to claim 1, wherein the ball-joint bearing is interposed between the first and second frame elements and supports a portion of the first frame element onto a corresponding portion of the second frame element, the ball-joint bearing being provided along a longitudinal axis extending centrally between the drive wheels and between the caster wheels; and wherein the ball-joint bearing exhibits a main bearing axis that is comprised within a vertical plane passing by the longitudinal axis.

3. The motorized wheelchair chassis according to claim 2, wherein the main bearing axis is substantially vertical.

4. The motorized wheelchair chassis according to claim 2, wherein the ball-joint bearing comprises a bearing socket provided on one of the first and second frame elements and a bearing stud designed to be received inside the bearing socket, which bearing stud is provided on the other one of the first and second frame elements.

5. The motorized wheelchair chassis according to claim 1, wherein the coupling structure further comprises a retaining mechanism designed to retain the first frame element onto the second frame element, as well as the ball-joint bearing in engagement between the first and second frame elements, while permitting the relative movement of the first frame element with respect to the second frame element about the ball-joint bearing.

6. The motorized wheelchair chassis according to claim 5, wherein the retaining mechanism includes at least a screw or bolt element cooperating with a retaining element to retain the first frame element onto the second frame element.

7. The motorized wheelchair chassis according to claim 6, wherein the retaining mechanism further includes at least a first elastic member, which first elastic member is disposed along a portion of the screw or bolt element and is interposed between the first and second frame elements.

8. The motorized wheelchair chassis according to claim 7, wherein the retaining mechanism further includes at least a second elastic member, which second elastic member is disposed along another portion of the screw or bolt element and is interposed between the retaining element and the first or second frame element.

9. The motorized wheelchair chassis according to claim 1, wherein a wheelbase of the motorized wheelchair chassis is adjustable.

10. The motorized wheelchair chassis according to claim 9, wherein the second frame element is securable to the battery support assembly at a plurality of longitudinal positions along a longitudinal axis.

11. The motorized wheelchair chassis according to claim 1, further comprising an elastic structure interposed between the first and second frame elements.

12. The motorized wheelchair chassis according to claim 11, wherein the elastic structure comprises first and second elastic elements interposed between the first and second frame elements.

13. The motorized wheelchair chassis according to claim 12, wherein the first and second elastic elements are rubber springs.

14. The motorized wheelchair chassis according to claim 12, wherein the first and second elastic elements are located on either side of the battery support assembly, between the drive wheels and the battery support assembly.

15. The motorized wheelchair chassis according to claim 1, wherein the battery support assembly supports first and second battery units.

16. The motorized wheelchair chassis according to claim 15, wherein the first battery unit is arranged in front of the second battery unit in a longitudinal configuration along a longitudinal axis, and wherein clearances are provided in the lateral sides of the battery support assembly, next to the location of the first battery unit, to accommodate part of the first and second power drive assemblies.

17. The motorized wheelchair chassis according to claim 1, further comprising a power electronic module, which power electronic module is mounted on a front face of the battery support assembly.

18. The motorized wheelchair chassis according to claim 1, wherein the at least one battery is accessible from a rear end of the battery support assembly.

19. A motorized wheelchair comprising a motorized wheelchair chassis in accordance with claim 1.

* * * * *